United States Patent [19]

Allen

[11] 3,970,126

[45] July 20, 1976

[54] LOG DEBARKER

[75] Inventor: W. Henry Allen, Sherwood, Oreg.

[73] Assignee: Kockum Industries, Inc., Talladega, Ala.

[22] Filed: July 14, 1975

[21] Appl. No.: 595,594

[52] U.S. Cl. ..... 144/208 E

[51] Int. Cl.[2] ..... B27L 1/00

[58] Field of Search..... 144/208 E, 208 R, 208 F, 144/208 A, 208 J

[56] References Cited

UNITED STATES PATENTS

| | | | |
|---|---|---|---|
| 2,623,558 | 12/1952 | Andersson | 144/208 E |
| 2,798,519 | 7/1957 | Hansel | 144/208 E |
| 2,802,495 | 8/1957 | Nicholson | 144/208 E |
| 3,361,168 | 1/1968 | Brown | 144/208 E |
| 3,667,517 | 6/1972 | Bentley et al. | 144/208 E |

*Primary Examiner*—Donald R. Schran
*Attorney, Agent, or Firm*—Klarquist, Sparkman, Campbell, Leigh, Hall & Whinston

[57] ABSTRACT

A rotary ring-type log debarker has barking tools operated by double-acting air cylinders with air pressure supplied through solenoid valves from a pressure chamber in the rotor. During normal debarker operation the rotor pressure chamber is isolated from an external source of air pressure. Air is supplied to the rotor pressure chamber intermittently only when necessary to maintain or increase air pressure in the chamber through a pilot air-operated ring-type air seal between the rotor and its stator. The seal is loaded only during the addition of air to the rotor pressure chamber to minimize wear on the sealing surfaces. Positive, instantaneous opening and closing of the tools and changes in air pressure in the rotor pressure chamber are effected from a remote operator's console while the rotor is either rotating or stationary.

25 Claims, 8 Drawing Figures

FIG. 1
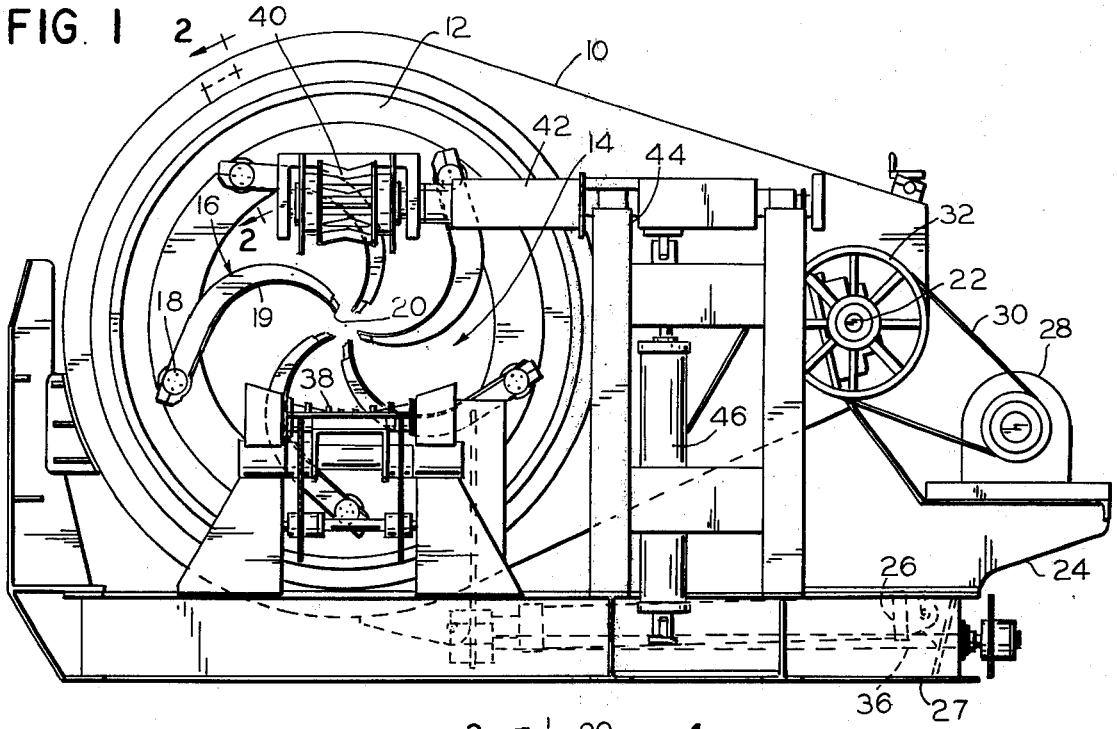
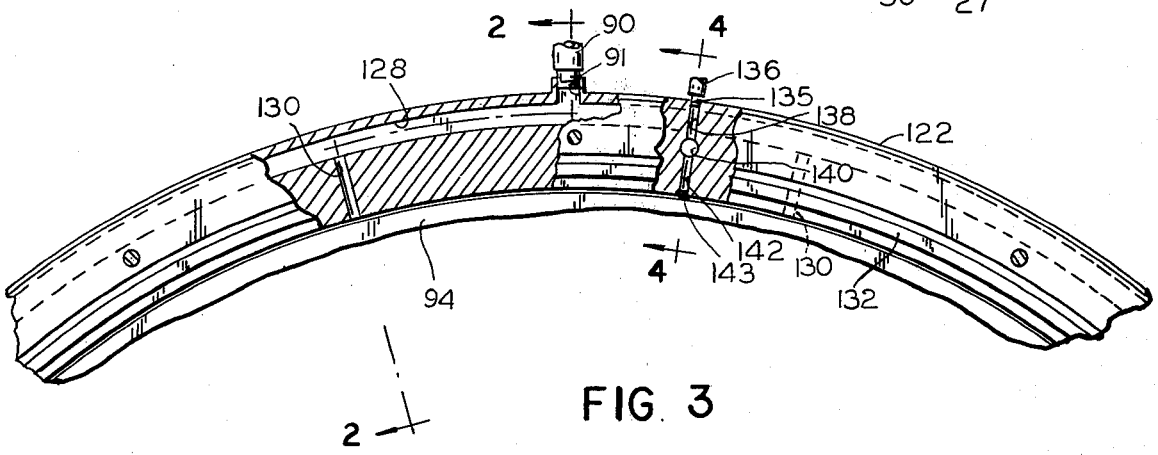
FIG. 3

10
10a
12
12a
14
16
18
18a
18b
34
52
52a
58
68
70
71
90
91
92
94
100
102
104
106
108
110
112
114
116
118
120
122
124
125
126
128
130
132
133
135
136
138
140
142
143
3

LOG DEBARKER

BACKGROUND OF THE INVENTION

1. Field of the Invention

The present invention relates to log debarkers and more specifically to an air-operated log debarker of the rotary ring type.

2. Description of the Prior Art

Many rotary ring-type debarkers have hydraulically operated barking tools with their hydraulic actuating motors and the pressurized hydraulic supply being carried by the rotor. The rotor hydraulic supply is pressurized at the desired pressure level while the rotor is stationary and may be varied slightly during rotation of the rotor through the use of a small electric motor-operated pump on the rotor.

Air pressure-operate barking tools for ring-type debarkers have been proposed to replace the captive hydraulic system described above because an air-operated system is theoretically less complex and faster acting than the hydraulic system. An air system also eliminates the need for carrying a hydraulic supply and pump on the rotor and the need for charging the rotor with fluid when the rotor is stationary since pressurized air can be directed into the rotor from an external source though an appropriate seal while the rotor is operating. However, the use of air to operate the barking tools raises the problem of providing an appropriate air seal that is effective and long-lasting.

Most prior ring-type debarkers using air-operated barking tools require a constant external supply of pressurized air to the rotor to maintain tool-operating pressure during normal operation. This in turn requires the air seals to be in constant sealing engagement while the debarker operates, causing rapid seal wear and thus frequent stoppages for maintenance.

The one ring-type debarker with air-operated tools as exemplified by Hansel U.S. Pat. No. 2,798,519, an air pressure reservoir in the rotor is charged while the rotor is stationary to provide tool-operating air. However, when the debarker is operating there is no way to increase tool or reservoir pressure by adding outside air. Outside air is required to open the tools while the rotor operates, and therefore an air seal is still required.

Other rotary ring debarkers with air-operated barking tools as exemplified by Brown U.S. Pat. No. 3,361,168 employ single-acting air springs to close the tools and apply tool pressure. Centrifugal force is relied on to open the tools, and therefore the tools cannot be opened for maintenance or to clear broken logs while the rotor is stationary. Air for operating the springs to close the tools and maintain tool pressure during normal operation is supplied by one or more air reservoirs in the rotor. Nevertheless, in this type of debarker external air must be continually supplied to the rotor to position rotor valves for supplying air from the reservoirs to the air springs. Thus the rotor air seal must remain continually operative to maintain air pressure on the air springs and barking tools.

In another air-operated debarker utilizing single-acting air springs to apply tool pressure, as exemplified by Bentley et al U.S. Pat. No. 3,667,517, the rotor is pressurized to maintain tool pressure during normal debarker operation while spring-biased valves on the rotor maintain rotor air pressure. However, external air pressure is required to open and close the tools though operation of the aforesaid valves. Also, the rotor must be completely exhausted of air to permit centrifugal force to open the tools. This requires a complete recharging of the rotor with external air upon each closing of the tools. External air is required to apply an air seal upon each tool opening and closing function.

thus in all known ring-type debarkers with air-operated tools, air from an external source must be added either while the rotor is stationary, continually while the rotor operates, or at least both to open and close the tools, requiring constant or at least frequent and prolonged loading and therefore rapid wearing of the air seal. Moreover, the tools of most such debarkers are opened using centrifugal force rather than positive fluid pressure.

SUMMARY OF THE INVENTION

A primary objective of the present invention is to provide a ring-type debarker with air-operated barking tools which can be both opened an closed instantaneously using positive air pressure both during operation of the rotor and while the rotor is stationary.

Another principal objective of the invention is to provide a debarker as aforesaid having a rotor with an integral air pressure chamber which, during normal debarker operation provides air for maintaining tool pressure and for opening and closing the barking tools, thereby minimizing the need for external air.

Another primary object is to provide a debarker as aforesaid in which external air need be supplied to the rotor only to increase air pressure within the rotor air pressure chamber or to replace slight amounts of such air normally lost during opening of the barking tools.

Another significant object is to provide a debarker as aforesaid in which the rotor air pressure chamber is sized and correlated with the displacement of the air cylinders, tool shaft moment arm, and centrifugal force of the barking tools to effect a specific design change in tool-operating pressure as log diameter changes.

Another important object is to provide a debarker as aforesaid with a ring-type air seal between the rotor and its stator operated by a pilot air pressure, but only intermittently when air is added to the air pressure chamber, to minimize seal wear.

Another important object is to provide for the aforesaid debarker a romotely operated control system which automatically supplies makeup air to the rotor air pressure chamber when required to maintain a predetermined air pressure in such chamber.

The foregoing objectives are embodied in a debarker in which the tool arms are operated by double-acting air cylinders on the rotor supplied by air from the rotor air pressure chamber through remotely controlled, electrically operated valves between the pressure chamber and cylinders.

The rotor air pressure chamber is annular and concentric about the axis of the rotor and normally isolated from an annular air pickup ring on the rotor by check valves. A pilot air-operated air seal ring seals the rotor air pickup chamber only when external air is added to the rotor air pressure chamber through the check valves. Pilot air for the air seal and primary air for the air pressure chamber are supplied from a common air source external to the rotor through an air control circuit which automatically applied pilot air at a pressure below primary air pressure to the air seal ring just prior to the supply of primary air to the rotor air pressure chamber and relieves the pilot air pressure just after the rotor pressure chamber is recharged. Further control means in the air circuit automatically supply makeup air to the air pressure chamber upon reclosing of the tools after some air has been lost upon opening of the tools.

The rotor is also provided with an integral annular exhaust air chamber into which air from the exhaust side of the double-acting air cylinders is passed. A remotely controlled, electrically operated air bleed valve is provided in an air passage between the rotor pressure chamber and the rotor exhaust chamber to enable lowering of the operating air pressure in the pressure chamber while the rotor is operating. The exhaust chamber has ports exhausting to atmosphere at points removed from the locus of bark removal to avoid a problem of blowing bark and debris.

The foregoing and other objects, features and advantages of the present invention will become more apparent from the following detailed description, which proceeds with reference to the accompanying drawings.

BRIEF DESCRIPTION OF THE DRAWINGS

In the drawings:

FIG. 1 is a front elevational view of a log debarker in accordance with the invention;

FIG. 3 is a sectional view taken approximately along the line 3—3 of FIG. 2;

DETAILED DESCRIPTION

General Assembly

Figures 2, 4:
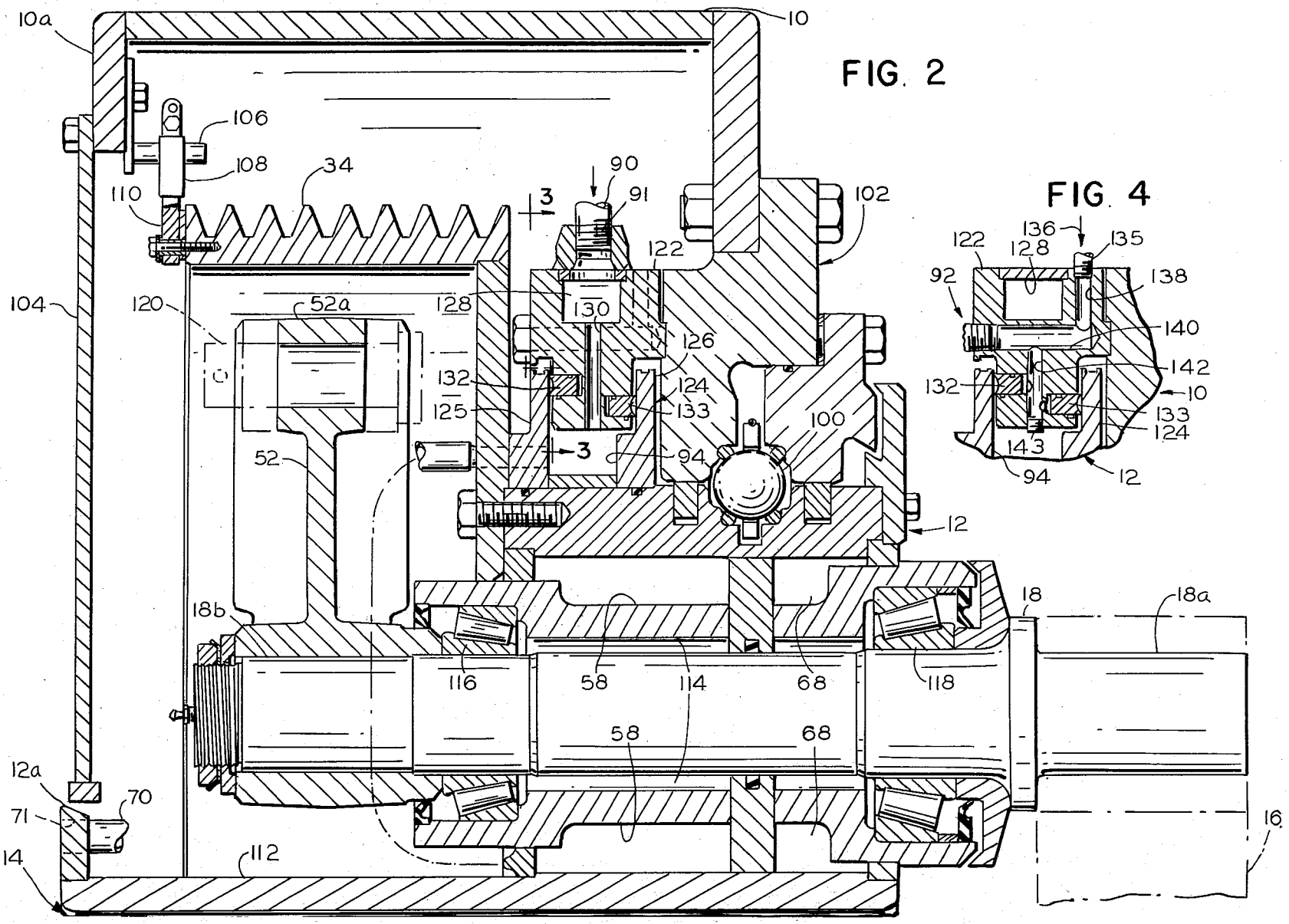
FIG. 2 is a radial sectional view through a portion of the rotor and rotor housing of the debarker taken approximately along the line 2—2 of FIG. 1.
FIG. 4 is a sectional view taken approximately along the line 4—4 of FIG. 3.

Referring first to FIG. 1 of the drawings, a ring-type log debarker of the invention includes a rotor housing 10 rotatably mounting an annular rotor 12 having a central opening 14 through which logs are passed during the debarking operation. The rotor carries a series of, in this case five, barking tools 16 projecting into center opening 14 and symmetrically mounted about the rotor on tool shafts 18 for pivoting movement between closed operating positions as shown to open positions clear of a log within such opening. The tools 16 have curved arms 19 curving from their shafts toward the center of the opening and terminating at hardened steel tips 20 at their free outer ends. The tools are pivoted by air-operated means to be described between their full open and closed positions to engage logs of various diameters within opening 14, as rotor 12 rotates in a counterclockwise direction as viewed in FIG. 1.

Rotor housing 10 is mounted for pivoted movement about the horizontal axis of a pivot shaft 22 carried by a stationary support pedestal 24. A hydraulic cylinder 26, hidden from view in FIG. 1, is pivoted at one end to the support frame 27 and at its opposite end to a lower portion of the rotor housing 10 to adjust the height of the center opening of the rotor to accomodate logs of varying diameter. A drive motor 28 on the base frame transmits power via a drive belt 30 to a sheave 32 on a jack shaft 22 which in turn transmit power through a further belt drive (not shown) to a rotor sheave 34 shown in FIG. 2.

A second frame-mounted motor (not shown) supplies power for driving horizontally extending shafts, one of which is shown at 36 in FIG. 1 for driving a lower series of ribbed infeed and outfeed conveyor chains with chairs 38. An opposed set of upper undriven idler rolls are urged downwardly against a log to drive it through the rotor opening 14. One such idler roll is shown at 40 on the infeed side of the rotor in FIG. 1. Roll 40 is carried at the outer end of an arm 42 extending laterally from upwardly extending standards 44. Arm 42 is pivoted at the upper end of standard 44 and moved about its pivot axis to apply a downward pressure to a log by a hydraulic cylinder 46, also pivoted to support frame 27.

ROTOR CONSTRUCTION

Figure 5:
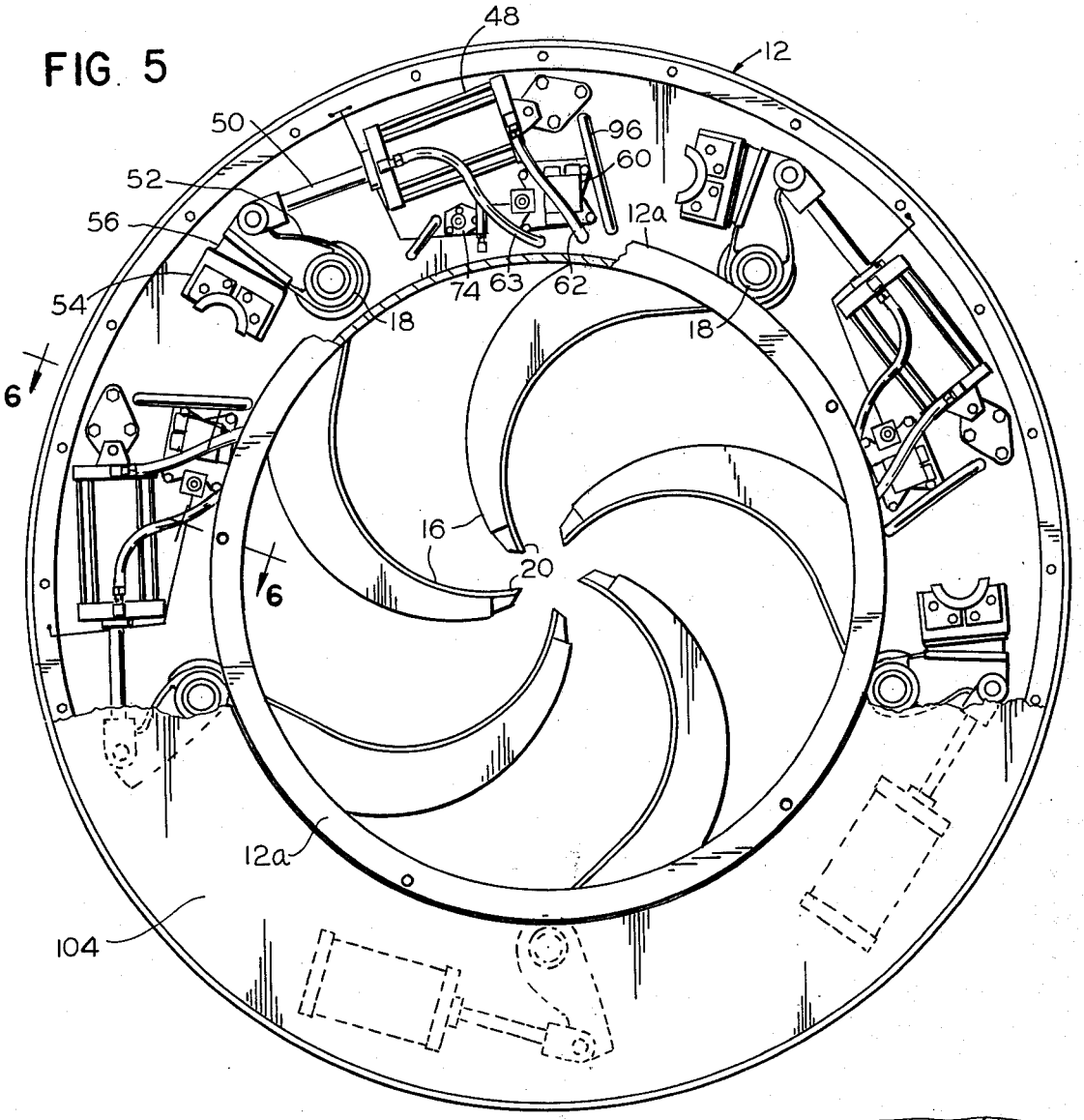
FIG. 5 is a rear view of the rotor of the debarker of FIG. 1 shown on an enlarged scale and with a portion of the back cover plate removed.

Referring to FIG. 5, the five tool arm shafts 18 are rotated in their bearings to pivot their connected tool arms 16 by five double-acting air cylinders 48 mounted on the back side of the rotor. Each cylinder 48 has a piston rod 50 pivoted at its outer end to the outer end of a crank arm 52 which in turn is fixed to one end of tool shaft 18 for pivoting the shaft and thus its connected tool arm. A bumper block 54 fixed to a rear wall of the rotor and associated with each crank arm 52 limits pivoting movement of the crank arm upon extension of piston rod 50. Each bumper block 54 has its crank-confronting face lined with a resilient pad 56. The associated crank arm 52 has a broad machined face which engages the bumpr pad when the tools are closed to absorb shock.

Figure 7:
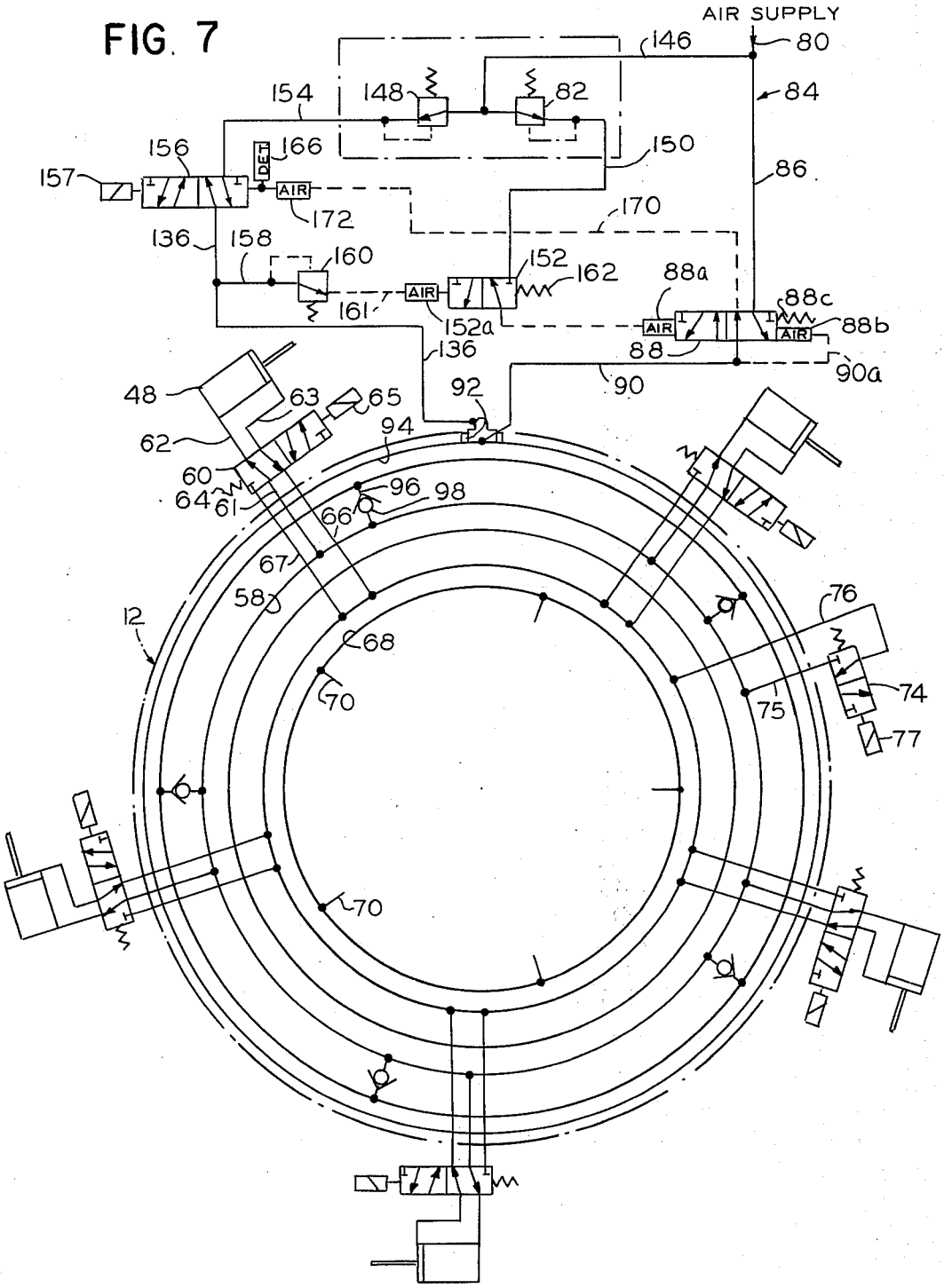
FIG. 7 is a diagram of the air control circuit of the invention.

Referring now to FIG. 7, each air cylinder 58 is supplied with air under operating pressure from a common annular air pressure chamber 58 built into the rotor. A solenoid-operated four-way valve 60 controls the supply of air to the opposite ends of each air cylinder 58 through an air supply passage 61 leading from pressure chamber 58 to the air valve and air hoses 62, 63 leading from the valve 60 to the opposite ends of the cylinder 48. Each cylinder control valve 60 is normally biased by a spring 64 into a position for supplying air to the cap end of each cylinder 48 and thereby urging the tool closed. The solenoid 65 of each control valve 60 when energized shifts the valve from is spring-biased position to a second position to reverse the flow of air to the cylinder to retract the piston rod and thereby open the associated tool arm.

Figure 6:
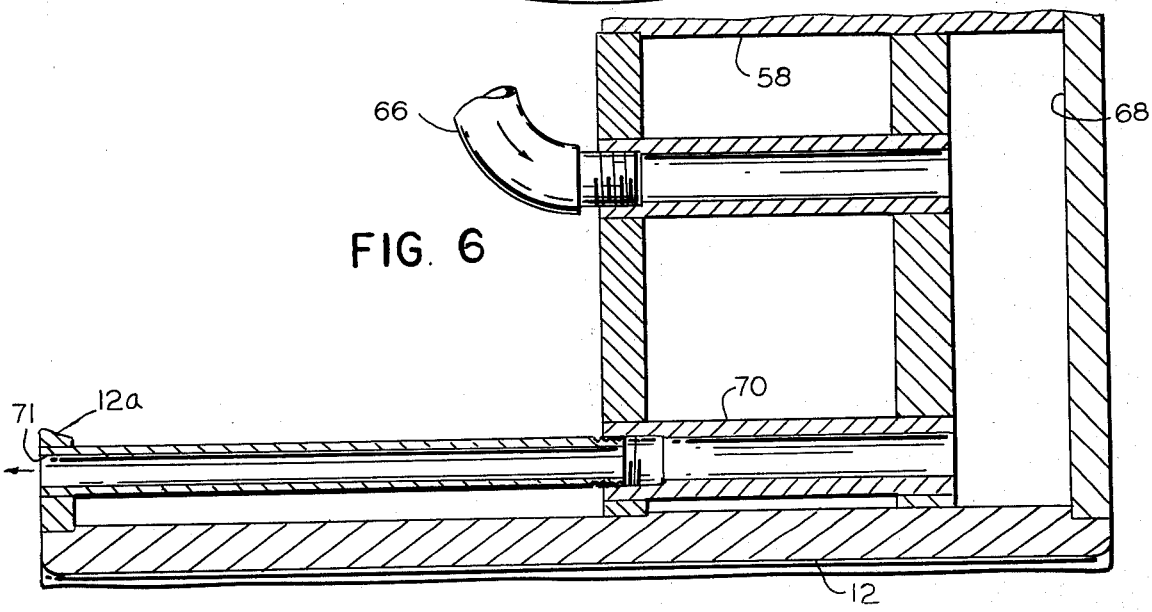
FIG. 6 is a sectional view taken approximately along the line 6—6 of FIG. 5.

When air is supplied to one end of the cylinder through passage 61 and one of the two hoses 62, 63, air is exhausted from the opposite end of the cylinder through the other one of the two hoses 62, 63 and one of two exhaust passages 66, 67 to an annular exhaust chamber 68 in the rotor. The exhaust air is exhausted from the exhaust chamber to atmosphere through appropriate exhaust passages 70 and ports 71 (see FIG. 6). the interrelationship of the pressure and exhaust chambers within the rotor is shown best in FIG. 6. Exhaust line 66 (also exhaust line 67) from air control valve 60 actually extends through the pressure chamber before opening into exhaust chamber 68. Exhaust passages 70 also extend through the pressure chamber before opening to atmosphere at an exhaust port 71 in a rear flange 12a of the rotor.

Means as shown in FIG. 7 are also provided on the rotor for selectively reducing the air pressure in the rotor air pressure chamber 58. Such means includes a solenoid-actuated air bleed valve 74 and a first air bleed line 75 leading from rotor pressure chamber 58 to the bleed valve and a second bleed line 76 leading from the valve to exhaust chamber 68. Bleed valve 74 is normally spring-biased to a closed position to maintain pressure in the rotor pressure chamber. Upon actuation of solenoid 77 for the bleed valve from a remote control point, the valve is shifted in opposition to spring pressure to a second "open" position where it remains to bleed air from the pressure chamber via the exhaust chamber to atmosphere so long as the solenoid remains energized.

The foregoing described cylinder valves 60 and bleed valve 74 may also be seen in FIG. 5.

Air Supply to Rotor

In applicant's debarker it is important to emphasize that air for operating the five tool-operating cylinders 48 is supplied solely from rotor air pressure chamber 58. No external air supply is used for this purpose. However, referring to FIG. 7, an external air pressure supply 80 is used to charge the rotor air pressure chamber 58, to supply makeup air to such chamber when required and to increase the air pressure in such chamber when desired. However, during normal debarker operation, that is, when the rotor is turning and the barking tools are closed, air from the external source 80 is not required, nor is it required for opening or closing the tool arms since solenoid-operated valves 60 serve this purpose. However, because exhaustion of air from one side of the tool cylinders upon opening of the tools reduces slightly the available air pressure in the rotor, makeup air is automatically provided to the rotor pressure chamber from external source 80 upon reclosing of the tools to maintain a predetermined pressure in the rotor pressure chamber. Such pressure is determined by a selectively variable air pressure regulator 82 in the air control circuit 84 shown in FIG. 7.

Air is added to the rotor pressure chamber 58, either while the rotor is stationary or rotating, from external air supply 80. Air is delivered though an external primary air supply line 86, a pressure-sensing valve 88, another external primary air supply line 90, a ring-type air seal 92 between the rotor and its stator into an annular rotor air pickup chamber 94. Air from pickup chamber 94 is delivered to the air pressure chamber through multiple air passages 96 provided with check valve 98 to prevent the back flow of air from the pressure chamber to the pickup chamber.

The air seal and air control circuit will be described in greater detail later.

Rotor Mounting Details

Referring to FIG. 2, rotor 12 is face-mounted on a stator 102 to provide as open and unfettered bark disposal as possible. The rotatable mounting of the rotor 12 on stator 102 is accomplished primarily by means of the ball bearings 100 and associated bearing structure. Stator 102 is affixed to and therefore comprises a portion of the cylindrical rotor housing 10 which is in surrounding relationship to the belt sheave portion 34 of the rotor. A back cover plate 104 of the housing extends downwardly across the back of the rotor, terminating close to the upwardly extending rotor flange 12*a*. Back cover plate 102 is connected at its outer periphery to a downwardly extending flange 10*a* of housing 10. The inner face of such flange carries a mount 106 for electrical brushes 108 which are in electrically conductive engagement with an annular collector ring 110 on the rear-most end of rotor belt sheave 34. By such means electrical power for operating the rotor solenoids is transmitted from the housing to the rotor.

An inner cylindrical rotor wall portion 112 defines the radially inner limits of the rotor and the central opening 14 therethrough.

The rotor also includes five generally cylindrical tool shaft mounting sleeve portions, one of which is indicated generally at 114. Sleeve 114 mounts at its opposite ends tapered roller bearing assemblies 116, 118 which rotatably support tool shaft 18. A reduced forward end 18*a* of tool shaft 18 mounts a bark tool 16, shown in phantom in FIG. 2. At its opposite rear end 18*b*, shaft 18 mounts the inner end of crank arm 52 for one of the tool cylinders 48. An enlarged outer end 52*a* of the crank arm receives a pivot pin 120 interconnecting such arm and piston rod 50 of the associated air cylinder 48.

Air Seal Details

The air seal details will be described with reference to FIGS. 2, 3 and 4. The primary air supply line 90 previously described with reference to FIG. 7 leads into an annular male air seal member 122 affixed to and thus comprising part of stator 102. This male air seal member extends inwardly of an annular female air seal member 124 on the rotor having opposed radially extending sidewalls 125, 126 which together with an inner end surface of male air seal member 122 define the previously mentioned annular air pickup chamber 94 of the rotor. Primary air from passage 90 enters an annular air distribution chamber 128 in male air seal member 122. From such chamber primary air is distributed through radial air supply passages 130 in the male air seal member to the rotor air pickup chamber 94 as shown in FIGS. 3 and 2.

During normal rotor operation, external air supply valve 88 of the air control circuit shown in FIG. 7 is closed so that no external air enters air distribution chamber 128 in the housing. Also during normal rotor operation, rotor air pickup chamber 94 is not pressurized, there being clearance between the sidewalls of the female air seal member 124 and the male air seal member 122. It is only when there is a need to add air to the rotor to increase the air pressure in rotor pressure chamber 58 that rotor air pickup chamber 94 is pressurized. For this purpose a pair of annular air seal rings 132, 133 carried by male air seal member 122 on the stator are forced by a pilot air pressure into sealing engagement with the sidewalls of the female rotor air seal member 124 just before primary air is delivered to rotor air pickup chamber 94.

The means for supplying pilot air pressure to the air seal rings 132, 133 is shown best in FIGS. 3 and 4. Pilot air from external air supply 80 of FIG. 7 is supplied to an intake port 15 at the outer periphery of stationary male air seal member 122 from a pilot air line 136 of the air control circuit 84 of FIG. 7. Pilot air entering port 135 proceeds through a radial air passage 138 to a lateral air passage 140. Another radial pilot air passage 142 extends down through the center of male air seal member 122 between the lateral annular channels which house air seal rings 132, 133. These channels are in communication with the central radial passage 142 so that when pilot air pressure is admitted to the male air seal member, the channels are pressurized behind air seal rings 132, 133, forcing such rings outwardly into sealing engagement with the sidewalls of female rotor air seal member 124 as shown best in FIG. 4. The lower end of the radial pilot air passage 142 is plugged at 143 so that pilot air does not enter rotor air pickup chamber 94. Air seal rings 132, 133 are preferably made of bronze metal or other suitable sealing material. As shown in FIG. 3, the radial pilot air passages 142 and 138 and lateral passage 140 are offset circumferentially from the primary air distribution passages 130 in male air seal member 122 so that the air passages of the primary and pilot air systems are completely isolated from one another.

Air Control Circuit

With reference to FIG. 7, air control circuit 84 includes the primary air line 86, 90 leading from the air pressure supply 80 to he air intake port 91 of male air seal member 122 of the stator 102 (see FIG. 2). A branch air line 146 leads from primary air supply line 86 to the primary air pressure regulator 82 and to a separate pilot air pressure regulator 148. An air line 150 leads downstream from primary air pressure regulator 82 to an air-operated relay valve 152.

A pilot air line 154 leads downstream from pilot air pressure regulator 148 to a solenoid-actuated master air control valve 156. A pilot air line 136 leads downstream from master control valve 156 to the pilot air intake port 135 (FIG. 4) of male air seal member 122 on the rotor housing. A branch pilot air line 158 branches from line 136 to a pilot air-operated sequencing valve 160. Pilot air flowing through sequencing valve 160 is directed through a pilot air line 161 to one end of pilot air-operated relay valve 152 in opposition to a valve spring 162.

Operation of Air Control Circuit

Figure 8:
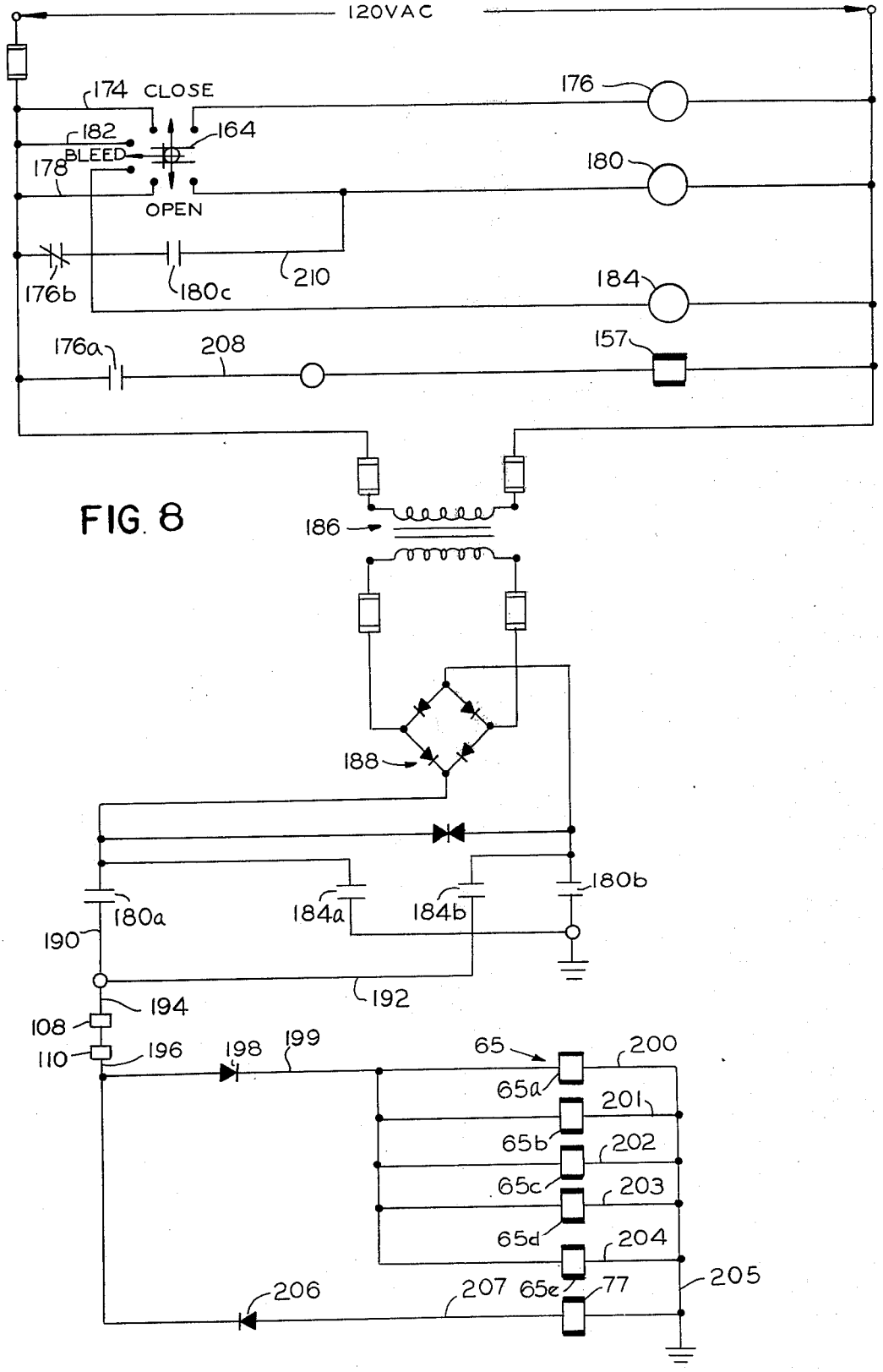
FIG. 8 is a diagram of the electrical control circuit of the invention.

All tool functions are controlled by a single spring-centered lever-operated switch 146 shown in the electrical control circuit diagram of FIG. 8. Such switch controls energization of all valve solenoids. In a first "close" position of such switch the five tool cylinder control valve solenoids on the rotor are deactivated, causing such cylinder valves to shift under spring pressure to close the barking tools. At the same time solenoid 157 for master control valve 156 in the air circuit is energized.

In a second "open" position of the three-position control switch, the valve solenoids for the five cylinder valves 60 in the rotor are energized, shifting such valves to open the barking tools.

In the third "bleed" position of three-position switch 164, only solenoid 77 of rotor air bleed valve 74 is energized to reduce air pressure in the rotor pressure chamber 58.

The air pressure level in the rotor pressure chamber 58 is controlled by selecting the desired pressure setting of the pressure regulator 82 in the air control circuit, which is a conventional dial face pressure regulator provided on the operator's console. The pilot air pressure acting on air seal rings 132, 133 is controlled by selecting a desired pressure setting on pilot air pressure regulator 148. The pilot air pressure may be set at a level below the primary air pressure to minimize seal wear.

During the normal operation of the rotor during debarking, all controls are in the positions shown in FIG. 7. The barking tool air cylinders 48 are extended and the solenoid-operated cylinder control valves 60 on the rotor are in their indicated positions to admit air from rotor pressure chamber 58 to the cap ends of the tool cylinders. Primary air at the pressure of air supply 80 is available to the pressure-sensing valve 88 and to the two pressure regulators 82, 148. Primary air pressure is available to relay valve 152 and pilot air pressure to the master control valve 156 through pressure regulators 82, 148 respectively. Master control valve solenoid 157 is de-energized, and therefore there is no air flow through master control valve 156 to the air seals and sequencing valve and no air flow through relay valve 152 to pressure-sensing valve 88. Thus air seal rings 132, 133 are unloaded and rotor air pickup chamber 94 is unpressurized. Check valves 98 on the rotor prevent the back flow of air from rotor pressure chamber 58 to rotor pickup chamber 94.

To open the barking tools, three-way switch 164 is moved momentarily to its "open" position. This energizes a relay which transmits an electrical signal through the brushes on the rotor housing and the slip ring on the rotor to energize the solenoids 65 of tool cylinder control valves 60 to reverse the direction of air flow from rotor pressure chamber 58 to tool-operating cylinders 48, pressurizing the rod ends and opening the cap ends thereof to exhaust. The piston rods retract to open the barking tools. Solenoids 65 remain energized by the aforementioned relay and thus air valves 60 remain in their "tool open" positions until the operating lever is again moved momentarily to its "close" position.

To reclose the barking tools, lever-operated switch 164 is momentarily moved to its "close" position to interrupt the aforementioned relay and de-energize the solenoids 65 of tool cylinder control valves 60, thereby allowing valve springs 64 to return valves 60 to their normal "tool closed" positions as shown.

Also when lever-operated switch 164 is moved to its "close" position momentarily, solenoid 157 for master control valve 156 is energized, shifting valve spool 156 to the right in FIG. 7 where it is held by a detent 166 even after solenoid 157 is de-energized upon return of the lever-operated switch 164 to its centered neutral position. Air at a pressure determined by pilot air pressure regulator 148 passes through the now-open master control valve 156 and pilot air line 136 and through the pilot air passages of male air seal member 122 into the annular channels behind air seal rings 132, 133, forcing such rings out against the sidewalls of female air seal member 124 of the rotor.

Pilot air pressure acting on sequencing valve 160 opens such valve at a pressure determined by the valve's own prssure setting, admitting air through pilot line 161 to the pilot 152a of relay valve 152, shifting the relay valve to its open position. Air at primary air pressure from regulator 82 passes through the open relay valve 152 to the pilot 88a of pressure-sensing valve 88. This causes the pressure-sensing valve 88 to shift to the right in FIG. 7, permitting air at supply pressure to pass from line 86 through valve 88 and into air distribution chamber 128 of male air seal member 122. From there the primary air passes through the radial air supply passages 130 into the annular air pickup chamber 94 of the rotor, now sealed by air seal rings 132, 133. From the rotor air pickup chamber 94 the primary air passes though rotor air passages 96 and check valves 98 into the air pressure chamber 58, pressurizing such chamber at a pressure determined by the pressure setting of the main pressure regulator 82.

As soon as the pressure in rotor pressure chamber 58 equals the pressure setting of pressure regulator 82, a second valve pilot **88*b*, sensing pressure downstream of valve 88 through pilot line 90*a* and assisted by a return spring 88*c*, overcomes pilot air pressure acting at pilot 88*a* to return valve 88 to its closed position. This shuts off primary air flow from supply 80 to the air distribution chamber of the male air seal member. Residual air pressure in rotor air pickup chamber 94 and air distribution chamber 128 is now transmitted back through pressure-sensing valve 88 and a pilot line 170 to a pilot 172 of main control valve 156, overcoming detent 166 to return the control valve to its closed position. when control valve 156 closes, pilot air pressure from line 154 to the air seal rings 132, 133 is cut off. Residual pilot air acting on the seal rings is exhausted through control valve 156 to atmosphere. When pilot line 136 is open to exhaust, pilot air pressure acting on sequencing valve 160 and relay valve 152 is relieved, allowing these valves to return to their normal positions. Thus pilot 88a of pressure-sensing valve 88 is also relieved of air pressure. In this way, any reduction of air pressure in the rotor pressure system caused by exhaustion of air from one side of the tool cylinders during tool opening, is automatically replaced to the original operating pressure level as determined by the setting of pressure regulator 82** during reclosing of the tools.

To increase the pressure in the rotor air pressure chamber 58, either while the rotor is operating or at rest, the setting of the main pressure regulator 82 is increased to the desired new level. Then lever-operated switch 164 is moved momentarily to its "close" position, energizing the same circuitry and initiating the same sequence of operations as previously described with reference to the tool reclosing function. The circuitry and components return to normal automatically when the newly selected pressure level is attained.

To selectively decrease air pressure in the rotor pressure chamber 58 and thus the working pressure of the barking tools, lever-operated switch 164 is moved to its "bleed" position and held there until the desired pressure reduction is achieved. This energizes only solenoid 77 for rotor bleed valve 74, shifting such valve to open communication between rotor pressure chamber 58 and the rotor exhaust chamber 68 through bleed passages 75, 76. Thus air is gradually bled from the pressure chamber to atmosphere, and air pressure in the rotor pressure chamber is accordingly reduced.

Pressure can be restored automatically to any level selected on main pressure regulator 82 by moving lever-operated switch 164 momentarily to the "close" position.

Pressure reduction can also be effected by lowering the selected pressure level on the main regulator 82 and then snapping the tools open and then closed by moving the lever-operated switch first to "open" position and then to its "close" position in rapid sequence. Pressure is automatically restored to the newly selected lower level.

An optional automatic pressure-reducing system, not shown, can also be provided. This would involve use of solenoid-operated check valves between the rotor air pickup chamber 94 and the rotor pressure chamber 58 instead of the check valves 98. The lever-operated switch 164 would be provided with a fourth position in which the solenoid-operated check valves could be opened to bleed pressure from the pressure chamber 58 back through the rotor pickup chamber 94 to atmosphere through the inoperative air seals 132, 133.

Electrical Control Circuit

FIG. 8 discloses a simple electrical control circuit for controlling the operation of the valve solenoids of the air pressure control system just described. As previously mentioned, the electrical control circuit contains the single lever-operated three-way switch 164 which in a first "close" position completes a circuit through line 174 to energize a master control valve relay 176. In a second "open" position of switch 164, a circuit is completed through line 178 to energize a second, tool cylinder valve relay 180. In the third "bleed" position of switch 164, a circuit is completed through a line 182 to energize a bleed valve relay 184.

The relay circuits are connected across a 120 volt a.c. power source which is transformed to 24 volts across a transformer 186. The alternating current is then rectified by the full wave rectifier 188 which transmits its output to the four normally open relay contacts including a positive relay contact **180*a* of tool cylinder valve relay 180, a positive bleed valve relay contact 184*a*, a negative bleed valve relay contact 184*b*, and a negative tool cylinder valve relay contact 180*b*. Leads 190, 192 from the positive relay contact 180*a*, and negative relay contact 184*b*, respectively, lead to a common conductor 194 connected to brushes 108 on the rotor housing. These brushes transmit a signal through the collector ring 110 on the rotor to a primary rotor conductor 196 leading to a positive diode 198 in branch conductor 199 and to a negative diode 206 in branch conductor 207 leading to bleed solenoid 77. Branch conductor 199 leads to the five tool cylinder valve solenoids 65 indicated individually as solenoids 65*a* – 65*e* in parallel branch conductors 200–204 leading to ground through conductor 205.**

Operation of Electrical Circuit

Assuming that there is power to the electrical control circuit, its operation is as follows:

First, with the switch 164 in its normal centered position as shown, none of the three control circuit relays 176, 180, 184 are energizd since all three of the relay circuits 174, 182 and 178 are open. Thus the normally open contact 176a of master control valve relay 176 is open in an electrical circuit 208 containing the solenoid 157 for master control valve 156 in the air circuit. Thus master control valve 156 is closed. Similarly all of the four relay contacts **180*a*, 184*a*, 184*b* and 180*b* remain open and thus all five of the bark tool cylinder valve solenoids 65*a* – 65*e* are de-energized. Thus the bark tool cylinder valves 60 are in their spring-biased "tool closed" positions shown in FIG. 7, directing air from rotor pressure chamber 58 to the cap ends of tool cylinders 48 while the opposite ends of such cylinders are open through the same valves to rotor exhaust chamber 68. Thus tool-operating cylinders 48** are extended and the barking tools are closed.

To open the barking tools, three-way switch 164 is moved momentarily to its "open" position, closing circuit 178 to energize tool open relay 180. Relay 180 closes its normally open contact **180*c* in subcircuit 210,** which also includes the normally closed contact 176b of master control valve relay 176. Therefore the tool open relay 180 remains energized through such subcircuit even after three-way switch 164 returns to its centered neutral position to reopen line 178.

With tool open relay 180 energized, its positive and negative relay contacts 180*a* and 180*b* are closed, transmitting a positive signal through brushes 108 to the rotor and a negative signal to ground. The positive signal is transmitted through the positive diode 198 to energize the five tool cylinder valve solenoids 65*a* – 65*e*, thereby shifting the cylinder valves 60 to reverse the flow of air from the rotor pressure chamber 58 to the cylinders 48, retracting the cylinders and opening the barking tools. The barking tools remain open until three-way switch 164 is moved momentarily to its "close" position.

When three-way switch 164 is moved momentarily to its "close" position, completing a circuit through line 174, relay 176 is energized to open its relay contact 176*b* in line 210, thereby de-energizing tool open relay 180. Relay contacts 180*a* and 180*b* are reopened, de-energizing tool cylinder valve solenoids 65*a* – 65*e*. Cylinder valves 60 shift to their "tool close" positions under the influence of their springs 64 where they remain until the three-way switch 164 is again moved momentarily to its "open" position.

When relay 176 is energized as just described, it also closes relay contact 176*a* in circuit 208 to energize solenoid 157 of master control valve 156, shifting such valve to the right in FIG. 7 to its open position where it is held by the detent 166 as previously explained. It remains open until rotor pressure chamber 58 is charged to the level selected on the main pressure regulator 82, after which it recloses automatically under the influence of residual air pressure from the rotor pickup chamber as previously described in connection with operation of the air circuit. When master valve 156 recloses, pilot air acting on air seal rings 132, 133 is exhausted to atmosphere through the valve.

To bleed air from air pressure chamber 58, three-way switch 164 must be moved to its bleed position and held there until the air pressure in the rotor pressure chamber 58 is reduced to the desired level. When this occurs, switch 164 closes circuit 182 to energize bleed valve relay 184, closing its positive and negative relay contacts 184*a*, 184*b* leading to ground and to the brushes 108 respectively. The closing of relay contact 184b sends a negative signal through the brushes and slip ring to the rotor conductor 196 where it is transmitted through negative diode 206 in line 207 to energize bleed valve solenoid 77, shifting the bleed valve to its open position and thereby opening the rotor pressure chamber 58 to communication with rotor exhaust chamber 68 through bleed lines 75, 76. When switch 164 is returned to its centered neutral position, circuit 182 is reopened, de-energizing bleed valve relay 184 and opening its relay contacts 184*a*, 184*b* to de-energize bleed valve solenoid 77. Bleed valve 74 shifts to its closed position, again isolating rotor pressure chamber 58 from exhaust chamber 68.

Summary of Operation

From the foregoing it will be understood that the barking tools of the described air-operated debarker are opened, closed and maintained closed using positive air pressure from the rotor pressure chamber 58. Rotor chamber 58 therefore acts during normal operation of the debarker as a static pressure accumulator, being normally isolated from the external air supply 80 by the check valves 98 and from atmosphere by bleed valve 74. However, the air circuit 84 operates automatically to supply makeup air to rotor pressure chamber 58 to replace air lost from one side of the tool-operating cylinders upon opening of the tools and during reclosing of the tools.

Air pressure in the rotor pressure chamber 58 can also be selectively increased while the rotor is operating or stationary simply by increasing the pressure setting of the main pressure regulator 82 in the air circuit and then momentarily moving the single lever three-way switch 164 in the electrical control circuit to its tool-closing position. Thereupon the air circuit operates automatically to increase the pressure in the air pressure chamber to its newly selected level as set on pressure regulator 82.

The air circuit 84 also operates automatically to load the air seal rings under pilot air pressure to seal the rotor air pickup chamber just before primary air is added to the rotor pressure chamber. Pilot air pressure is determined by the pilot pressure regulator 148 in the air circuit. The air control circuit also operates automatically to relieve the air seal rings 132, 133 of pilot air pressure just after the supply of primary air to the rotor is cut off by pressure-sensing valve 88 of the air circuit.

The single lever-operated three-way switch 164 is also used to selectively reduce pressure in the rotor pressure chamber 58 through means previously described. This can be done either by moving the switch to its bleed position and holding it there or by lowering the pressure setting of the main pressure regulator and then moving the three-way switch first to its open position and then to its closed position in rapid sequence.

Through use of the rotor pressure chamber to supply air under operating pressure to double-acting tool-operating cylinders, and by providing solenoid actuation of the tool cylinder control valves 60, an exceptionally fast, positive opening and closing of the tools is achieved. All functions as described are selectively performed by the use of a single lever-operated three-way switch at the remote operator's console, either while the debarker is in operation or while it is stationary, without reliance on centrifugal force.

Through the use of the annular rotor air pressure chamber 58 common to all of the tool-operating cylinders 48, the applied tool pressure will vary with the diameter of the logs being debarked. The debarker is designed to correlate the volume of the rotor pressure chamber with the displacement of the tool-operating cylinders 48, the tool shaft moment arms and the centrifugal force of the barking tools during normal rotor operation so that the tools will apply specific variable design pressure for logs of different diameters. As log diameter increases, tool pressure will increase and the increase will follow a design pressure curve determined from experience with other rotary ring-type debarkers.

Having illustrated and described what is presently a preferred embodiment of the invention, for the purpose of illustrating the principles thereof, it should be apparent to persons skilled in the art that the invention can be modified in arrangement and detail without departing from such principles. I intend to claim as my invention all such modifications, variations and equivalents of the illustrated embodiment as come within the true spirit and scope of the following claims.

I claim:

1. In a ring-type log debarker having a housing, an annular rotor mounted for rotation on said housing, plural barking tools mounted on said rotor symmetrically about the axis of rotation thereof for movement between an open inoperative position and closed operative positions, tool-operating means including an air motor means for operating each barking tool, and an external source of air pressure to said rotor, the improvement comprising:

static air pressure chamber means within said rotor for supplying air under operating pressure to all of said air motor means, said air motor means comprising a separate double-acting air cylinder for opening and closing each said barking tool, remotely operable electrically operated cylinder control valve means on said rotor for controlling air communication between said rotor pressure chamber means and the opposite sides of said air cylinders, said valve means being operable in a first position to supply air from said pressure chamber means to one side of said cylinders and to exhaust air from the opposite side of said cylinders and being operable in a second valve position to exhaust air from said one side and supply air from said pressure chamber means to said opposite side of said cylinders for positive opening and closing of said barking tools, means on said rotor normally isolating said static air pressure chamber means from said external source of air pressure and from atmosphere during rotation of said rotor for maintaining said pressure chamber means under a predetermined static pressure, and means for adding pressurized air to said pressure chamber means from said extem al source during rotation of said rotor to maintain or increase static air pressure within said pressure chamber means.

2. Apparatus according to claim 1 wherein said pressure chamber means comprises a common pressure chamber for supplying air to all said air cylinders.

3. Apparatus according to claim 2 wherein said remotely operable cylinder control valve means comprise a series of separate electrically operated remote control valves, one for each said air cylinder.

4. Apparatus according to claim 2 wherein said static pressure chamber generally defines an annulus within said rotor having its center coincident with said rotor axis.

5. Apparatus according to claim 4 wherein said means for adding pressurized air to said pressure chamber includes an annular air pickup chamber within said rotor separated from said pressure chamber and concentric about said rotor axis, and air supply passage means interconnecting said air distribution chamber and said pressure chamber, said means normally isolating said air pressure chamber including check valve means on said rotor normally preventing the backflow of air from said pressure chamber through said supply passage means to said pickup chamber.

6. Apparatus according to claim 5 wherein said means for adding air to said pressure chamber includes an annular air distribution chamber in a stator portion of said housing concentric about said rotor axis, primary air passage means leading from said external air source to said air distribution chamber, air supply passage means interconnecting said air distribution chamber in said stator and said air pickup chamber in said rotor, and annular air seal ring means between said stator and said rotor operable to seal said pickup chamber when said distribution chamber is pressurized to enable transmission of air under pressure from said distribution chamber through said pickup chamber to said rotor pressure chamber.

7. Apparatus according to claim 6 wherein said stator includes an annular male air seal member defining said air distribution chamber and said supply passage means and extending into a female air seal member on said rotor defining said annular air pickup chamber, said air seal ring means including a pair of air seal rings carried by said male air seal member and movable under air pressure into sealing engagement with said female air seal member to seal said pickup chamber.

8. Apparatus according to claim 7 including air control circuit means operable to apply air pressure to said air seal rings for operating said seal rings each time external air under pressure is transmitted to said air distribution and pickup chambers, said air control circuit means being operable to relieve said seal rings of air pressure upon discontinuation of the supply of external air to said distribution and pickup chambers.

9. Apparatus according to claim 7 wherein said male air seal member includes pilot air passage means in communication with said air pressure source and said air seal rings such that said seal rings operate to seal said rotor air pickup chamber against loss of air pressure each time air under pressure is transmitted from said source through said distribution chamber into said pickup chamber.

10. Apparatus according to claim 4 wherein said rotor includes an annular exhaust chamber separated from said pressure chamber and concentric about said rotor axis, said remotely operable valve means being operable to connect the exhaust sides of said air cylinders to said exhaust chamber, and exhaust passage means connecting said exhaust chamber to atmosphere.

11. Apparatus according to claim 10 including air bleed passage means extending from said air pressure chamber to said exhaust chamber and remotely operable normally closed bleed valve means on said rotor selectively movable to an open position to selectively reduce the static air pressure in said pressure chamber.

12. Apparatus according to claim 1 including air bleed passage means in said rotor connecting said static pressure chamber means to atmosphere and normally closed remotely operable bleed valve means in said bleed passage means operable in an open position to selectively reduce the static air pressure in said air pressure chamber means to a desired level.

13. Apparatus according to claim 5 wherein said rotor includes an annular exhaust chamber separated from said pressure chamber and concentric about said rotor axis, said remotely operable valve means being operable to connect the exhaust sides of said air cylinders to said exhaust chamber, and exhaust passage means connecting said exhaust chamber to atmosphere.

14. Apparatus accordng to claim 1 including air presure control circuit means operable automatically upon movement of said remotely operable control valve means to position for closing said barking tools to supply makeup air from said external air source to said rotor pressure chamber means to maintain the static pressure in said rotor pressure chamber means at a predetermined level.

15. In a ring-type log debarker having a frame including a rotor housing, an annular rotor mounted for rotation on said housing, plural barking tools mounted on said rotor for movement between open and closed positions, and tool-operating means on said rotor, characterized by:

said tool-operating means comprising double-acting air-operated tool-operating cylinders, a common static air pressure chamber on said rotor for supplying air under operating pressure to said cylinders for opening and closing said tools, remotely operable tool cylinder control valve means on said rotor for controlling the supply of air from said rotor pressure chamber to the opposite ends of said tool-operating cylinders, and air supply means for supplying air under pressure to said rotor pressure chamber, said supply means including a rotor air pickup chamber formed at an intersection between said rotor and said housing, rotor air supply passage means leading from said pickup chamber to said pressure chamber and including means for preventing the backflow of air from said pressure chamber to said pickup chamber, air pressure-operated air seal means operable to form an airtight seal between said rotor and said housing at said intersection as said rotor rotates to seal said pickup chamber against the loss of air pressure, and an air control circuit means externally of said rotor operable automatically and sequentially upon movement of said remotely operable control valve means to positions for reclosing said barking tools after opening to (1) pressurize said air seal means, (2) add makeup air from said external air source through said rotor air pickup chamber to said rotor pressure chamber while said air seal means remains pressurized, (3) cut off the supply of air to said rotor pickup chamber from said external source, and (4) relieve said air seal means of air pressure.

16. Apparatus according to claim 15 wherein said air control circuit means includes primary air passage means leading from said external air source to said rotor air pickup chamber, pilot air passage means leading from said external air source to said air seal means, a primary air pressure regulator means controlling the air pressure in said primary air passage means at variable levels, master control valve means in said pilot air passage means normally blocking flow of pilot air to said air seal means, pressure-sensing valve means in said primary air passage means normally blocking flow of primary air through said primary air passage means to said rotor air pickup chamber, said master control valve means being selectively movable to a position to pressurize said air seal means, and pilot air-operated sequencing valve means operable upon pressurization of said air seal means to cause said pressure-sensing valve means to move to a position for pressurizing said rotor air pickup chamber.

17. Apparatus according to claim 16 wherein said pressure-sensing valve means is sensitive to back air pressure in said rotor pickup chamber and being movable under said back air pressure to its primary air flow blocking position when said back air pressure exceeds a pressure level determined by said primary air pressure regulator, said pressure-sensing valve means being operable upon return to said flow-blocking position to direct said residual back air pressure to said master control means to reclose said master control valve means, said master control valve means when reclosed being operable to depressurize said air seal means.

18. Apparatus according to claim 16 including pilot air-operated relay valve means between said sequencing valve means and said pressure-sensing valve means, said relay valve means being operable to direct primary air to a pilot of said pressure-sensing valve means to open said pressure-sensing valve means to primary air flow upon operation of said sequencing valve means.

19. Apparatus according to claim 15 wherein said air control circuit means is operable to apply pilot air to said air seal means at a lower pressure than the primary air transmitted to said rotor pressure chamber.

20. Apparatus according to claim 8 wherein said control means is operable to apply air pressure to said air seal rings only when air under pressure is supplied to said distribution and pickup chambers and under a pressure lower than the air pressure transmitted to said chambers.

21. Apparatus according to claim 6 including an annular exhaust chamber in said rotor separated from said annular pressure chamber and said annular pickup chamber, air bleed passage means interconnecting said pressure chamber and said exhaust chamber, remotely operable bleed valve means for opening and closing said bleed passage means and thereby controlling the reduction of static air pressure in said pressure chamber, said remotely operable tool cylinder control valve means comprising a separate control valve for each said air cylinder, pressure air passage means extending from said pressure chamber to each said control valve, exhaust air passage means extending from each said control valve to said exhaust chamber, cylinder air passage means extending from each said control valve to the opposite sides of an associated said air cylinder, said control valves being operable in a normal spring-biased first position to pressurize one side of said air cylinders and exhaust the opposite side to close said barking tools, said control valves being selectively movable electrically to a second position to pressurize said opposite side of said air cylinders and exhaust said one side to open said barking tools.

22. Apparatus according to claim 4 wherein said means for adding pressurized air to said pressure chamber includes an annular female air seal member on an outer circumferential portion of said rotor and an annular male air seal member on an inner circumferential portion of said housing and extending within said female member and defining with said female member an annular air pickup chamber on said rotor, said male member including an annular primary air distribution chamber and primary air passage means interconnecting said distribution and pickup chambers, said distribution chamber being connected to said external air source, air passage means in said rotor interconnecting said rotor pressure chamber and said pickup chamber, a pair of annular air-operated sealing rings carried by said male member, said sealing rings being movable into sealing engagement with walls of said female member under a pilot air pressure less than the pressure of primary air supplied to said air distribution chamber, and pilot air passage means in said male member connected to a source of pilot air pressure for transmitting pilot air pressure to said sealing rings for sealing said pickup chamber.

23. In a ring-type log debarker having a frame including a rotor housing, an annular rotor mounted for rotation on said housing, plural barking tools mounted on said rotor symmetrically about the axis of rotation thereof for movement between an open inoperative position and closed operative positions, tool-operating means including an air motor means for each barking tool, and an external source of air pressure to said rotor, the improvement comprising:

said air motor means comprising double-acting air cylinders, said rotor including a common static air pressure chamber for supplying air under operating pressure to all said cylinders for opening and closing said barking tools, a normally unpressurized air pickup chamber on said rotor at an intersection between said rotor and said housing for receiving air from said external source of air pressure, first air passage means on said rotor interconnecting said pickup chamber and said pressure chamber for supplying air only to said pressure chamber, second air passage means on said rotor interconnecting said pressure chamber and said air cylinders, said air cylinders being isolated from direct communication with said pickup chamber and said external source of air pressure, check valve means on said rotor operable to prevent the backflow of air from said pressure chamber through said first passage means to said pickup chamber and thereby to maintain said static pressure chamber at a desired static pressure, tool cylinder control valve means on said rotor remotely operable to direct air from said pressure chamber selectively into opposite sides of said air cylinders for providing positive opening and closing of said barking tools, said control valve means being normally biased in a first position wherein air pressure from said pressure chamber maintains siad tools in a closed operative position without the addition of external air to said pressure chamber, said valve means being selectively movable to a second position wherein pressure from said pressure chamber moves said tools to their open positions and maintains said tools in their open positions without the addition of external air to said pressure chamber.

24. Apparatus according to claim 23 wherein said second valve means comprise a series of electrically operated control valves operable from a control station remote from said rotor.

25. Apparatus according relative to claim 23 wherein said rotor pressure chamber is sized relativeto the displacement of said air cylinders, mechanical advantage of actuating linkage between said air cylinders and said barking tools and centrifugal force acting on said barking tooks to provide a predetermined design tool operating pressure for a given log diameter and with a predetermined static air pressure in said pressure chamber, and to provide predetermined design changes in said tool-operating pressure upon changes in said log diameter without changing said predetermined static air pressure in said pressure chamber through the exhaust of air therefrom or the addition of external air thereto.

* * * * *

UNITED STATES PATENT AND TRADEMARK OFFICE

CERTIFICATE OF CORRECTION

PATENT NO. : 3,970,126

DATED : July 20, 1976

INVENTOR(S) : W. Henry Allen

It is certified that error appears in the above-identified patent and that said Letters Patent are hereby corrected as shown below:

Column 1, line 18; "pressure-operate" should be --pressure-operated--;
Column 1, line 38; "The" should be --In--;
Column 1, line 67; "though" should be --through--;
Column 2, line 6; "thus" should be --Thus--;
Column 2, line 19; "an" should be --and--;
Column 2, line 45; "romotely" should be --remotely--;
Column 2, line 64; "applied" should be --applies--;
Column 4, line 4; "transmit" should be --transmits--;
Column 4, line 37; "bumpr" should be --bumper--;
Column 4, line 39; "58" should be --48--;
Column 4, line 43; "58" should be --48--;
Column 4, line 51; "is" should be --its--;
Column 4, line 63; "the" (first occurrence) should be --The--;
Column 6, line 63; "15" should be --135--;
Column 7, line 23; "he" should be --the--;
Column 8, line 58; "prssure" should be --pressure--;
Column 9, line 19; "when" should be --When--;
Column 10, line 49; "energizd" should be --energized--;
Column 14, line 63, claim 14; "accordng" should be --according--;
Column 18, line 8, claim 23; "siad" should be --said--;
Column 18, line 20, claim 25; delete "relative".

Signed and Sealed this

Fourth Day of January 1977

[SEAL]

*Attest:*

RUTH C. MASON
*Attesting Officer*

C. MARSHALL DANN
*Commissioner of Patents and Trademarks*